US008398136B2

(12) United States Patent
Miles

(10) Patent No.: US 8,398,136 B2
(45) Date of Patent: Mar. 19, 2013

(54) APPARATUS FOR STORAGE AND RETRIEVAL

(76) Inventor: Shane Robert Miles, Upper Coomera (AU)

( * ) Notice: Subject to any disclaimer, the term of this patent is extended or adjusted under 35 U.S.C. 154(b) by 270 days.

(21) Appl. No.: 12/734,257

(22) PCT Filed: Oct. 22, 2008

(86) PCT No.: PCT/AU2008/001555
§ 371 (c)(1),
(2), (4) Date: Jun. 28, 2010

(87) PCT Pub. No.: WO2009/052558

PCT Pub. Date: Apr. 30, 2009

(65) Prior Publication Data

US 2010/0308615 A1 Dec. 9, 2010

(30) Foreign Application Priority Data

Oct. 22, 2007 (AU) ..... 2007229415

(51) Int. Cl.
*B60N 3/10* (2006.01)
*B60R 9/06* (2006.01)

(52) U.S. Cl. ..... 296/1.01; 296/37.1; 296/37.6

(58) Field of Classification Search ..... 296/1.1, 296/37.1, 37.6, 24.33, 24.35; 224/404
See application file for complete search history.

(56) References Cited

U.S. PATENT DOCUMENTS

| | | | | | |
|---|---|---|---|---|---|
| 2,509,341 | A * | 5/1950 | Goldsmith | 174/77 R |
| 2,859,083 | A | 11/1958 | Devlin et al. | |
| 3,347,591 | A * | 10/1967 | Soroos et al. | 296/168 |
| 3,406,999 | A * | 10/1968 | Kozicki | 296/156 |
| 3,471,045 | A * | 10/1969 | Panciocco | 414/522 |
| 4,150,861 | A | 4/1979 | Dufrancatel | |
| 4,534,601 | A * | 8/1985 | Zwick | 312/266 |
| 5,029,935 | A * | 7/1991 | Dufrancatel | 296/156 |
| 6,077,024 | A * | 6/2000 | Trueblood | 414/462 |
| 6,814,383 | B2 * | 11/2004 | Reed et al. | 296/24.3 |
| 7,111,884 | B2 * | 9/2006 | Johnson | 296/26.1 |
| 2001/0026756 | A1 * | 10/2001 | Mortimore | 414/556 |

FOREIGN PATENT DOCUMENTS

| | | |
|---|---|---|
| DE | 2524962 | 12/1976 |
| FR | 2 513 098 | 9/1981 |
| JP | 2005-087360 | 4/2007 |
| JP | 2005087360 | 4/2007 |

* cited by examiner

*Primary Examiner* — Glenn Dayoan
*Assistant Examiner* — Gregory Blankenship
(74) *Attorney, Agent, or Firm* — Stein McEwen, LLP

(57) ABSTRACT

This invention provides for an apparatus for storing one or more items. The apparatus comprises a first part adapted to be mounted to a surface or a wall and a second part mounted by a linkage arrangement to a sliding mechanism that can slidably move relative to the first part. The second part is adapted to store or hold one or more items. The second part is movable relative to the first part such that the second part can be moved from a storage position to a first access position at which the second part is at one level. The linkage arrangement is operative to move the second part from the first access position to a second access position, the second access position being located at a level spaced from that of the first access position.

21 Claims, 6 Drawing Sheets

94
40
44
40

92
40
110
130
94
40

124
126
122
112
116
120
114
118
110
40
116
120
108
106
102
100
104
44
40
126
124
122

APPARATUS FOR STORAGE AND RETRIEVAL

FIELD OF THE INVENTION

The present invention relates to an apparatus for storage and retrieval.

BACKGROUND TO THE INVENTION

Four-wheel-drive and off-road enthusiasts frequently undertake lengthy journeys into wilderness areas. In order to provide for the necessities of life during such journeys, it is common for such off-road enthusiasts to fit their vehicles with appropriate storage systems and refrigerators. Similarly, tradesmen often have to carry many tools in their vehicles and frequently use large tool boxes.

One common storage system fitted to four wheel drive and commercial vehicles includes sliding drawers mounted to a luggage compartment of such four wheel drive vehicles. The sliding drawers typically have a common top surface that provides a further surface for storing further items. It will be understood that the top surface is positioned at a height above the height of the floor of the luggage compartment of the vehicle.

Refrigerators and tool boxes that are used by four-wheel-drive and off-road enthusiasts (which are typically called "car refrigerators" or "car fridges") or tradesmen typically have a lid that pivots upwardly about a top edge thereof. In order to retrieve items in such refrigerators or tool boxes, they may be mounted on a sliding arrangement that itself is mounted to the common top surface of the storage drawers. In order to store the fridge or tool box, the sliding arrangement is slid into the vehicle such that the refrigerator or tool box sits over the top surface of the storage drawers. In order to retrieve and access the refrigerator or tool box, it is slid outwardly so that the sliding arrangement is extended and the refrigerator or tool box extends out of the luggage compartment of the vehicle.

Such arrangements are not limited to use with vehicles. They may be found in many situations where it is necessary to store goods and equipment in an efficient and accessible manner.

Throughout the specification, the term "comprising" and its grammatical equivalents shall be taken to have an inclusive meaning unless the context of use clearly indicates otherwise.

The applicant does not concede that any prior art discussed in the specification forms part of common general knowledge or is information that may be generally available to persons working in the field of the invention.

BRIEF DESCRIPTION OF THE INVENTION

It is an object of the present invention to provide an apparatus that provides an improvement over the prior art devices mentioned above, or at least provides a commercial alternative.

According to the invention, there is provided an apparatus for storing and retrieving one or more items, the apparatus comprising a first part adapted to be mounted to a support surface;

a second part suitable for supporting said one or more items;

a linear displacement mechanism interposed between the first part and the second part to permit the second part to be displaced linearly with respect to the first part in a plane parallel to the support surface into a first access position; and a linkage arrangement also interposed between the first part and the second part and configured to permit displacement of the second part with respect to the first part from the first access position to a second access position, the second access position being in a plane spaced from the support surface that facilitates retrieval of said one or more items.

The linear displacement mechanism may be a sliding mechanism that permits the second part to slide reciprocally relative to the first part.

The second access position may be operatively lower than the first access position.

In one embodiment, the second part slidably moves from the storage position to the first access position (and vice versa). When in the storage position, the second part may at least partially overlie the first part. In some embodiments, when in the storage position, the second part may be positioned at essentially the same level as the first part.

The first part, in one embodiment, may comprise opposed rails or sliding guides. The opposed rails or sliding guides can slidably receive sliding tracks therein. The opposed rails or sliding guides may be mounted to a surface or a wall. To facilitate this, the opposed rails or sliding guides may be provided with one or more openings through which appropriate fasteners, such as screws, bolts, nails or the like, can pass to enable the opposed rails or sliding guides to be mounted to a surface. Alternatively, the opposed rails or sliding guides may be fitted to brackets that can be mounted to a wall. As a further alternative, the opposed rails or sliding guides may be provided with attachment means for mounting to a surface. For example, the attachment means may comprise a strip of adhesive or adhesive tape.

In another embodiment, the sliding rails or guides are mounted to a base or a frame.

The second part may comprise a support frame. Alternatively, the second part may comprise a platform. In either case, the second part may be adapted to support one or more items thereon. For example, the second part may support a small refrigerator, such as a refrigerator commonly used in four-wheel-drive vehicles. It will be appreciated that the second part may provide support for a number of other items and that the present invention should not be considered to be limited solely to use in supporting small refrigerators.

The apparatus may further comprise actuating means for moving the second part from the first access position to the second access position. The actuating means may comprise, for example, an offset lever connected to one or more linkages. Moving the lever, such as by rotating the lever upwardly or downwardly, causes the linkages to rotate and causes the second part to move between the first and second access positions. A biasing means, such as a spring, hydraulic cylinder, gas strut or the like, may be used to assist in moving the second part between the first access position and the second access position. A handle may be pivotally connected to the offset lever to facilitate movement of the offset lever.

In a second embodiment, the present invention provides an apparatus for facilitating access to a car fridge or a tool box stored in a vehicle, the apparatus comprising a base or frame mounted in the vehicle, a sliding arrangement fixed to the base or frame, the sliding arrangement being slidably movable between a retracted position and an extended position, and a support platform being mounted to the sliding arrangement by a linkage arrangement such that when the sliding arrangement is in the extended position, the support platform is movable between a first height that is at essentially the same height as the sliding arrangement and a second height that is lower than a height of the sliding arrangement.

In another aspect, the present invention provides a storage device in which the first access position is lower than the second access position. This provides for easier access in situations where the first part is mounted at a low level.

Accordingly, in another aspect, the present invention provides an apparatus for storing a car fridge or a tool box in a vehicle, the apparatus comprising a base or frame mounted in the vehicle, a sliding arrangement fixed to the base or frame, the sliding arrangement being slidably movable between a retracted position and an extended position, and a support platform being mounted by a linkage arrangement to the sliding arrangement such that when the sliding arrangement is in the extended position, the support platform is movable between a first height that is at essentially the same height as the sliding arrangement and a second height that is lower than a height of the sliding arrangement.

In yet a further aspect, the present invention provides an apparatus for storing one or more items, the apparatus comprising a first part adapted to be mounted to a surface or a wall and a second part mounted by a linkage arrangement to a sliding mechanism that can slidably move relative to the first part, the second part adapted to store or hold one or more items, wherein the second part is movable relative to the first part such that the second part can be moved from a storage position to a first access position at which the second part is at one level, the linkage arrangement operative to move the second part from the first access position to a second access position, the second access position being located at a higher level than the first access position.

DETAILED DESCRIPTION OF THE DRAWINGS

Figure 1:
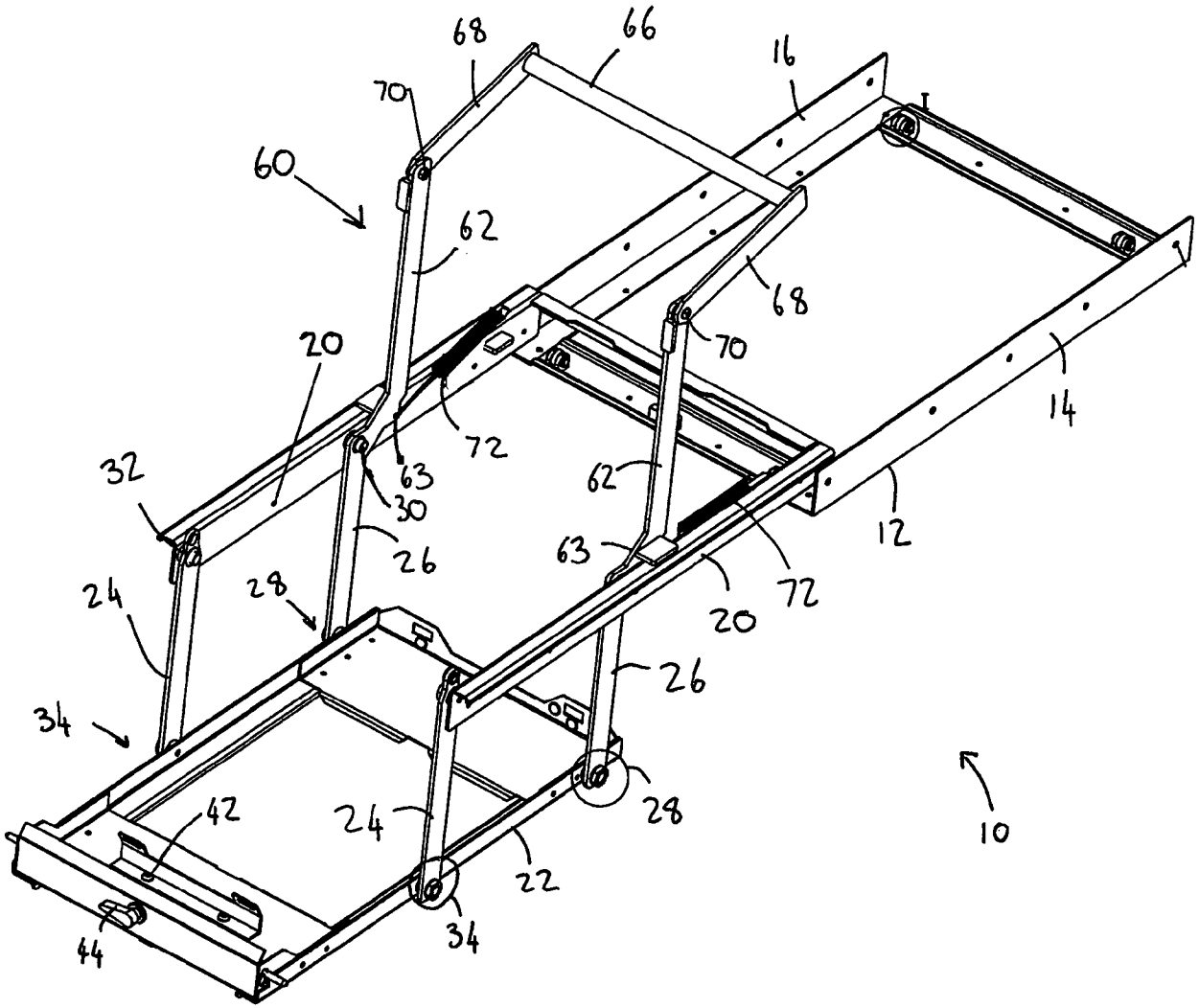
FIG. 1 shows a perspective view of an apparatus in accordance with an embodiment of the present invention, with the apparatus being shown in a second access position.
Figure 2:
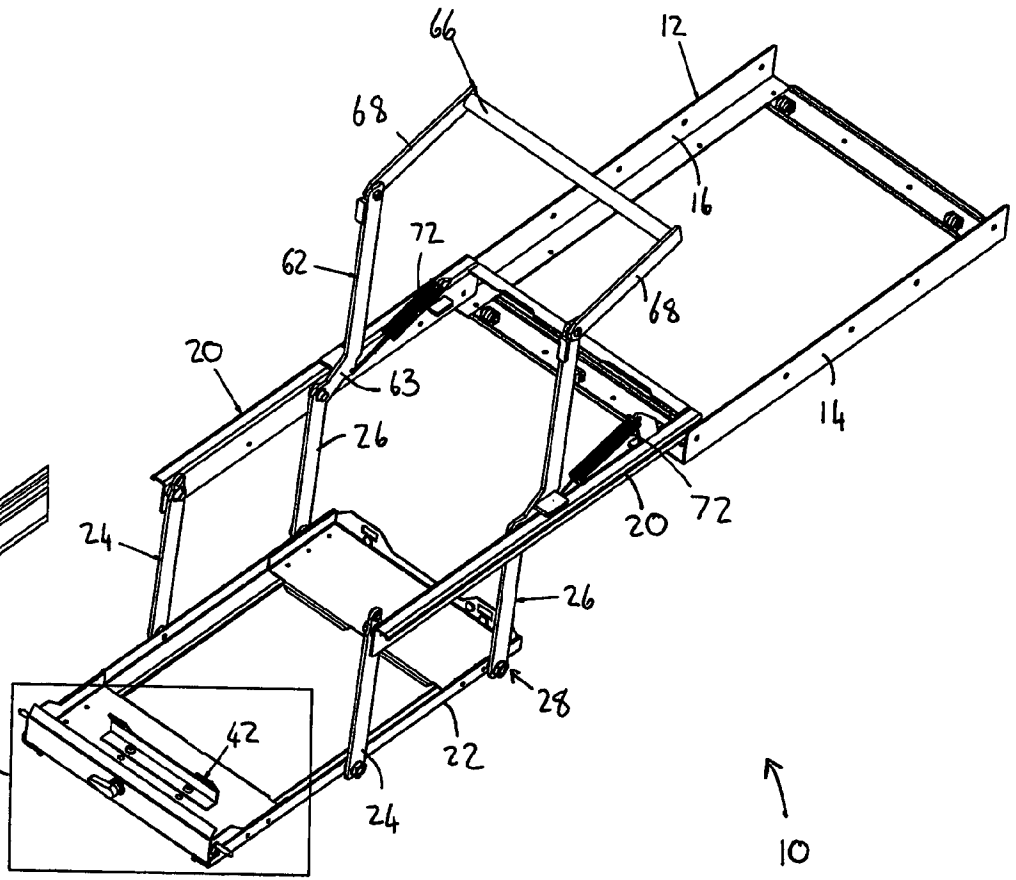
FIG. 2 shows a further perspective view of the apparatus shown in FIG. 1, with the apparatus being in the second access position.
Figure 3:
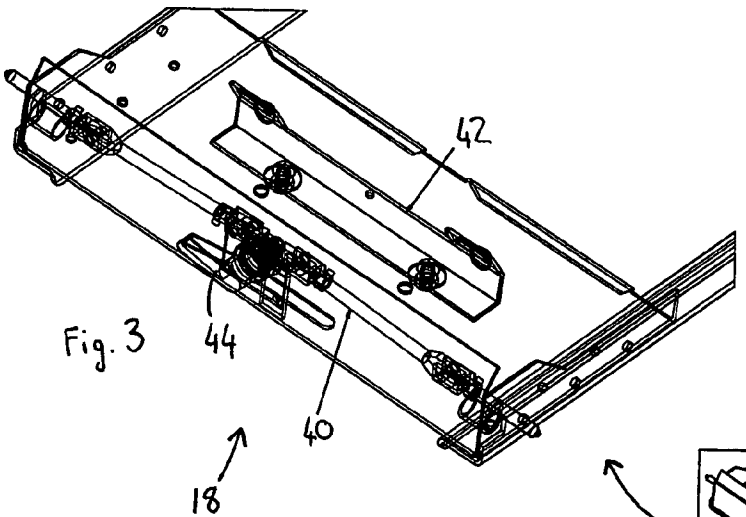
FIG. 3 shows a closer perspective view of a locking means of the apparatus shown in FIG. 1.

It will be understood that the drawings have been provided for the purpose of illustrating preferred embodiments of the present invention. Therefore, it will be appreciated that the present invention should not be considered to be limited solely to the features as shown in the accompanying drawings.

The apparatus shown in the accompanying drawings generally consists of a platform that can be used to store or hold one or more items. In the embodiments shown in the attached drawings, the platform is adapted to hold a small refrigerator that may be used in four wheel drive vehicles and motor cars. Such refrigerators are typically referred to as "car fridges". In the embodiments shown in the accompanying figures, the apparatus is mounted within the luggage compartment of a four wheel drive vehicle. In particular, the apparatus is mounted to a top surface of storage drawers that themselves are mounted to the luggage compartment of the four-wheel-drive vehicle. It will be understood that the top surface of the storage drawers are positioned approximately 15 to 30 cm above the floor of the luggage compartment of the vehicle. When a car fridge is placed on the top surface, it can be inconvenient to obtain access to the fridge (even if the car fridge is positioned on a slide which allows the fridge to be slid horizontally out of the luggage compartment) because the top part of the fridge (which typically provides access to the interior of the fridge) is quite high above the ground.

In the embodiments shown in the drawings, the platform comprises the second part of the apparatus.

The first part of the apparatus shown in the accompanying drawings comprises a base or frame that is mounted to a vehicle. The base or frame carries or supports two opposed tracks that, in turn, have further tracks mounted therein. The outermost tracks provide a sliding guide through which or along which at least one inner track can slide. The least one inner track may comprise a slide member and it may be fitted with one or more bearings to facilitate sliding movement relative to the opposed tracks. Two or more inner tracks may be used in order to enable a large extent of sliding, horizontal movement to be attained. The sliding track arrangement may be essentially conventional in design.

The platform may be mounted to the sliding track arrangement in a manner that allows the platform to be moved upwardly and downwardly between the first access position and the second access position. In the embodiments shown in the accompanying figures, the platform is mounted to the sliding track arrangement by use of pivoted linkage arms. One end of each arm is pivotally mounted to the sliding track arrangement and the other end of the arm is mounted to the platform. An actuator, such as an offset lever, is mounted to the least one of the linkage arms to enable a user to move the platform upwardly and downwardly between the first access position and the second access position. In the embodiments shown in the accompanying figures, one or more gas struts are used to assist in moving the platform between the first access position and the second access position.

Turning now to consider the figures in more detail, the apparatus 10 comprises a base or base frame 12. The base frame 12 has a number of holes or openings formed therein to enable the base frame 12 to be fastened or mounted to a vehicle, such as by use of bolts, screws or other suitable fasteners. The base frame 12 may suitably comprise a formed or shaped metal or plastic sheet. The base frame 12 provides for convenient mounting of the apparatus to a vehicle.

The base frame 12 defines a pair of opposed guides or tracks 14, 16 forming part of a sliding mechanism. The opposed tracks 14, 16 each receive at least one sliding member 20. The sliding members 20 may be in the form of sliding elongated members that carry one or more rollers or bearings to facilitate sliding movement. In one embodiment (not shown), each track 14, 16 carries a sliding member 20 and each of the sliding members further carries another sliding member in a telescopic manner. Such an arrangement allows further extension of the sliding members 20 from the base frame 12.

In the sliding mechanism of the shown embodiment, a support platform 22 is secured to the sliding members 20. This enables the platform 22 to be horizontally slid inwardly and outwardly as indicated by reference numeral 50 in FIG. 4. The support platform 22 is mounted to the sliding members 20 using a linkage arrangement comprising linkage arms 24, 26 that enable the platform 22 to be moved upwardly and downwardly between the first and second access positions.

As shown, the support platform 22 is mounted to the sliding arrangement by use of the two pivoted linkage arms 24, 26 on either side of the support platform 22. Linkage arm 24 is pivotally mounted at one end to a pin 28. Pin 28, in turn, is mounted to the support platform 22. The linkage arm 24 is pivotally mounted at its other end to a pin 30. Pin 30 is, in turn, mounted to the innermost sliding member 20.

As the platform 22 is mounted to the sliding mechanism, the platform 22 can be moved in an essentially horizontal direction by sliding it inwardly and outwardly. As mentioned above, this is shown by reference to arrow 50 in FIG. 4. Furthermore, as the platform 22 is mounted to the sliding arrangement by pivoting arms 24, 26, the arms may rotate about their upper pins in the direction as shown by arrows 52 and 54 in FIG. 4. This enables the platform to be moved from the first access position, as shown by reference numeral 56 in FIG. 4, to the second access position, as shown by reference numeral 58 in FIG. 4.

Figures 4, 5:
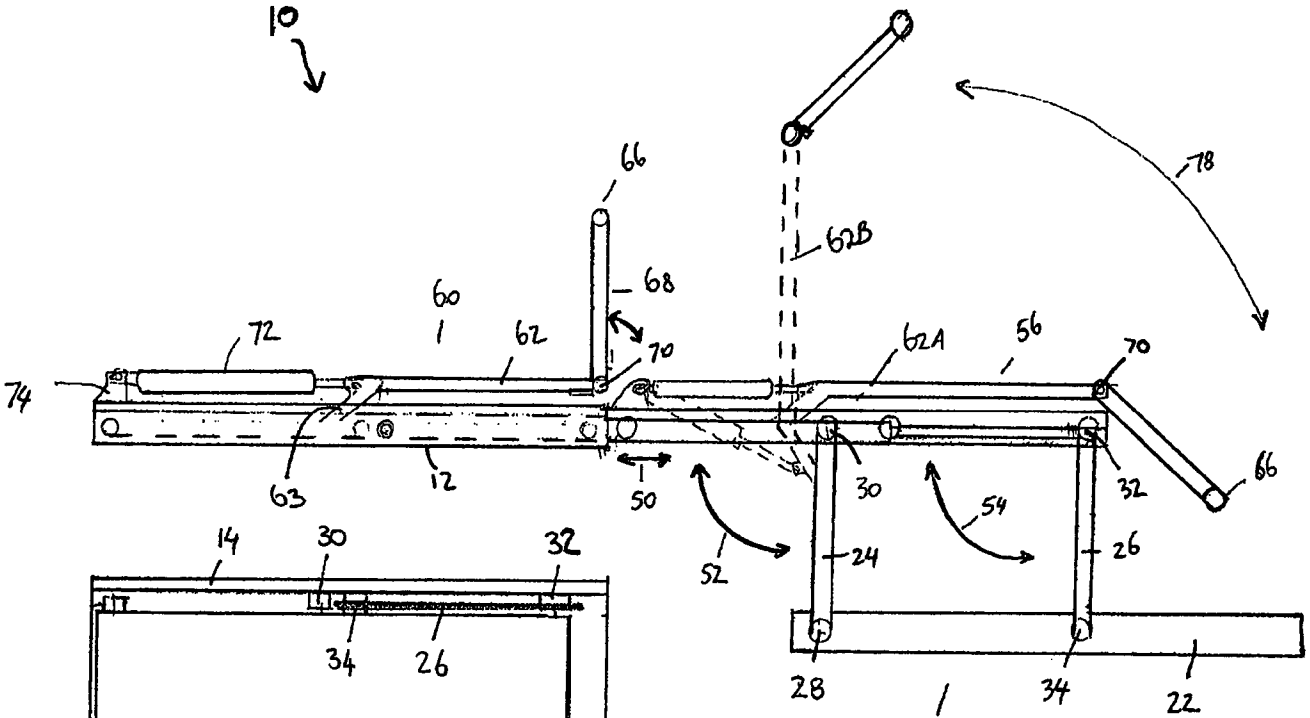
FIG. 4 shows a side view of the apparatus shown in FIG. 1, with the apparatus being moved from a storage position to a first access position, and finally to the second access position.
FIG. 5 shows a plan view of part of the apparatus shown in FIG. 1, with FIG. 5 showing greater detail of an interconnection between a storage platform, a slide and an interconnecting linkage.

In order to move the platform 22 between the first access position 56 and the second access position 58 (as shown in FIG. 4), the apparatus 10 is further provided with an actuating means 60. The actuating means 60 comprises an offset lever 62 having an offset portion 63 that is mounted to linkage arm 24. This may be achieved, for example, by welding the end of offset portion 63 to the linkage arm 24. A handle 66 is connected via pivoting arm 68 to the offset lever 62. A pin 70 is used to connect the pivoting arm 68 to the offset lever 62. A gas strut 72 is also provided (shown in FIG. 4). Gas strut 72 is connected at one end via bracket 74 to the sliding mechanism to which the platform 22 is connected. The other end of gas strut 72 is connected to the offset lever 62. As is shown in FIG. 4, as the platform 22 moves between the first access position 56 and the second access position 58, the gas strut extends to thereby facilitate lowering and raising of the platform 22. It is to be appreciated that the invention includes any similar means for assisting or activating the raising and lowering of the platform 22. For example, other embodiments may include hydraulic rams, pneumatic rams, mechanical assistors, etc.

In order to lower the platform 22 from the first access position 56 to the second access position 58, the handle 66 is grasped by a user and swung upwardly. This causes the offset lever 62 to move from the position 62A (see FIG. 4) to the position 62B (shown in FIG. 4 in dotted outline). As the end of the offset portion 63 of offset lever 62 is mounted to the linkage arm 24, moving the offset lever as described above (and as shown by reference to arrow 78) causes the linkage arm 24 to pivot downwardly. This also causes the linkage arm 26 to pivot downwardly. The support platform 22 also moves downwardly.

The offset lever 62 is dimensioned to provide a mechanical advantage to a user, thereby permitting items of a weight which would usually prohibit raising and lowering to be raised and lowered by the user.

The support platform 22 includes a support bracket 42 to secure an object, like a fridge, to the platform 22.

Figure 8:
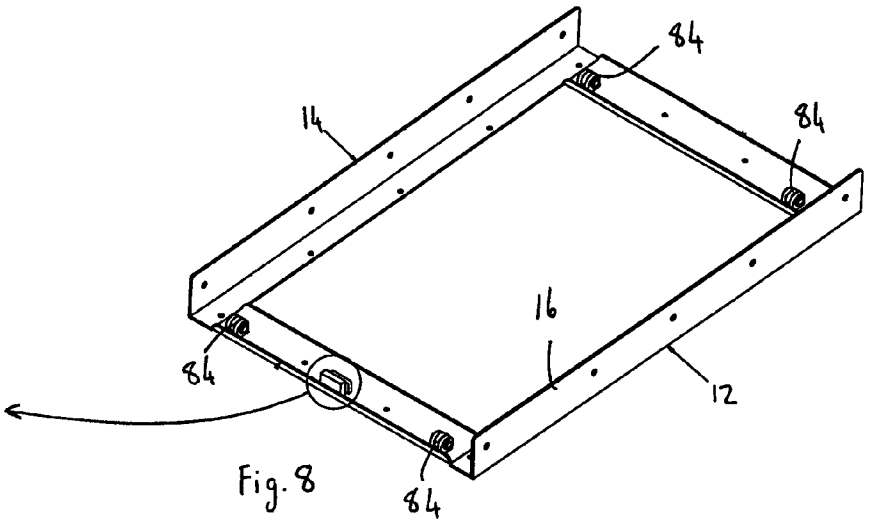
FIGS. 6 to 8 show different views of a base frame of the apparatus shown in FIG. 1.
Figure 7:
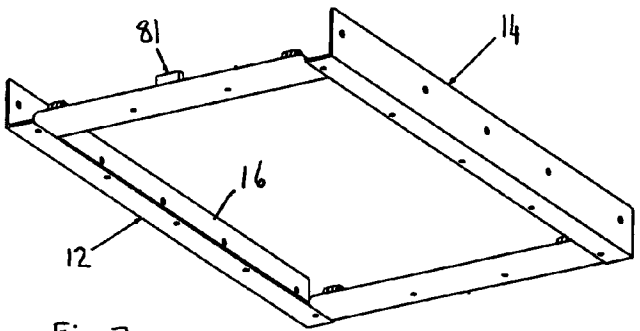
Figure 10:
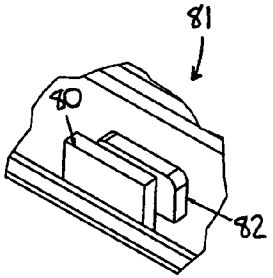
FIGS. 9 and 10 show closer detail of a roller bearing and a stop arrangement of the base frame of FIGS. 6 to 8.
Figure 9:
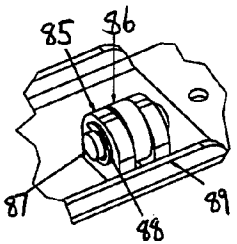
Figure 6:
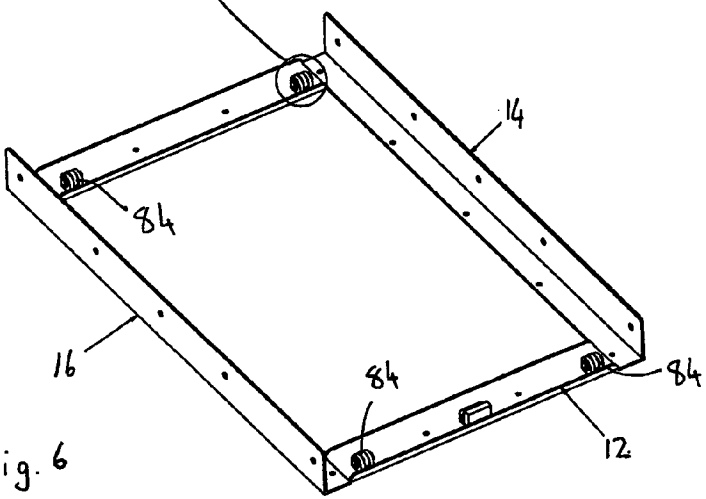

FIGS. 6 to 8 show the base frame 12 from different perspectives. The base frame 12 includes roller bearings 84 to support a weight placed on platform 22, in use. An example of such a bearing 84 is shown in more detail in FIG. 9. Each roller bearing 84 includes brackets 85 mounted against a ridge 89 on the base frame 12, as shown. The brackets 85 are spaced to accept bearings 86 between them held in place by bearing pin 87 secured by circlip 88. The base frame 12 further includes a stop arrangement 81 against which the sliding member 20 comes to a stop in the first access position. The stop arrangement 81 (shown in more detail in FIG. 10) includes a stop plate 80 and a stopper 82. The stopper 82 typically comprises an elastic material such as rubber to serve as a shock absorber when the sliding member 20 is slid into the first access position.

Figure 13:
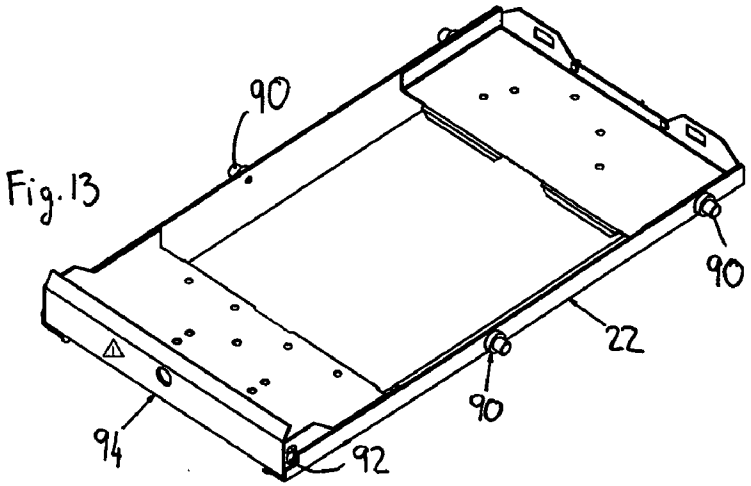
FIGS. 11 to 13 show different perspective views of a support platform of the apparatus shown in FIG. 1.
Figure 12:
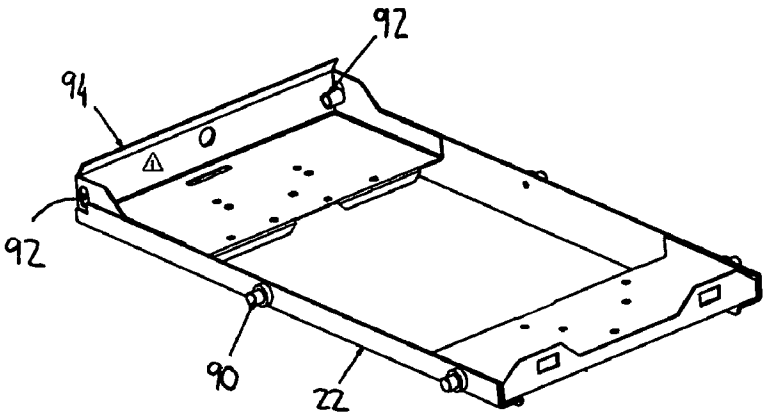
Figure 11:
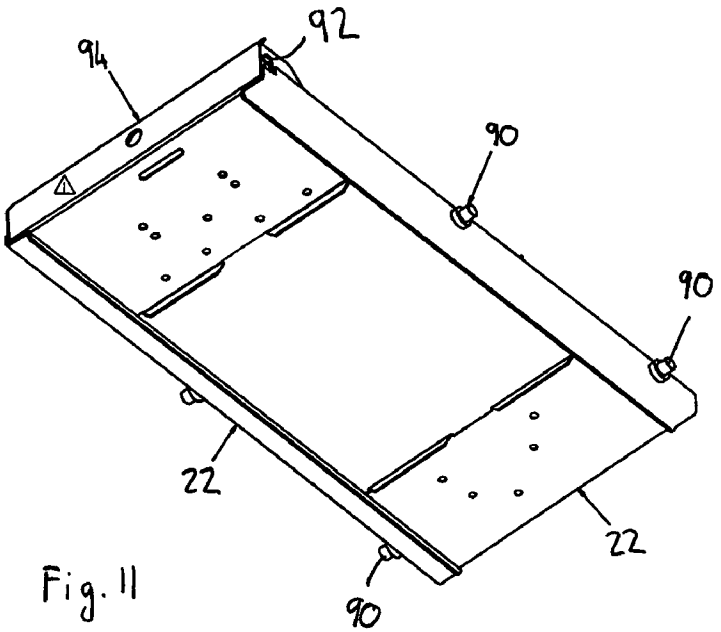

FIGS. 11 to 13 show the support platform 22 in more detail. Protrusions 90 form part of pin connections 28, 34 indicated in FIGS. 1 to 4 and discussed above. Front end 94 of the support platform 22 operatively houses locking means 18, discussed below. To this end, front end 94 includes a panel defining an aperture for a lock handle 44.

Figures 14, 15, 16:
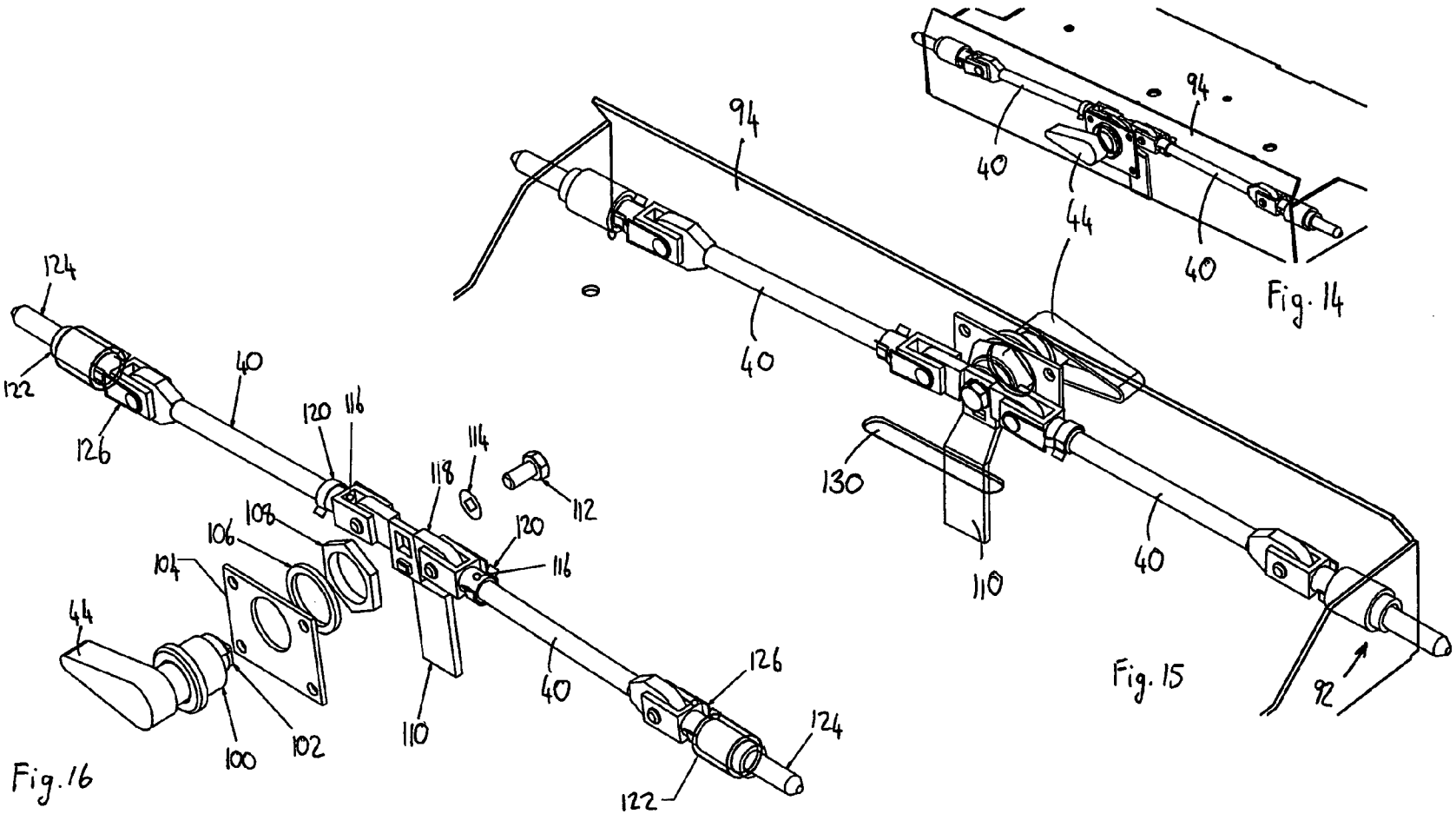
FIG. 14 shows a front perspective view of the locking means of FIG. 3.
FIG. 15 shows a rear perspective view of the locking means of FIG. 14.
FIG. 16 shows an exploded view of the locking means.

FIGS. 14 to 16 show the locking means 18 in more detail. Locking means 18 is provided to secure the platform in the storage position, typically when the apparatus 10 is in motion, such as during transport in a vehicle. The locking means 18 is mounted to the front end 94 of the support platform 22. In the embodiment shown, locking means 18 includes a three-point locking system. The locking means 18 includes two side pins 124 for engaging a suitable aperture in the base frame 12 when extended, along with tab 110 passing through aperture 130 in the support platform to impede sliding movement of the sliding member 20. To this end, locking means 18 includes lock handle 44 for actuating lock rods 40 to extend locking side pins 124 as well as tab 110. Lock handle fitting 100 is passed through front panel 94 and secured by bracket 104 and screw and washer 106, 108. End 102 of lock handle 44 engages a wing plate 118 attached via bushings 120 and securing pins 116 to the locking rods 40 on respective sides. End 102 is held in the wing plate 118 by means of screw 112 and washer 114, as shown. Locking rods 40 are attached to locking pins 124 via connectors 126 and bushings 122. Accordingly, turning locking handle 44 rotates wing plate 118 to extend or retract pins 124 and tab 110 to lock the support platform to the base frame 12.

The present invention provides an apparatus that allows for storage of one or more items in the storage position. For ease of access, the apparatus allows the second part to be moved to a first access position. The first access position is normally located outwardly from the storage position so that easier access is provided. The first access position is normally at essentially the same vertical height as the storage position. If the first access position is inconveniently or uncomfortably high, the second part of the apparatus can be moved from the first access position to the second access position. As the second access position is located at a lower level than the first access position, easier access may be obtained.

The present invention may be susceptible to variations and modifications other than those specifically described. For example, the apparatus may be provided with one or more motors or hydraulic rams or pneumatic rams to facilitate moving of the support platform from the first access position to the second access position (and vice versa). The sliding arrangement may be varied from that shown in the attached drawings. Although a support platform is shown in the embodiments described with reference to the figures, it will be appreciated that an item to be stored or held by the apparatus may be directly connected to the linkage arms. In other embodiments, the first access position may be located at a lower level than the second access position, which is useful in instances where the sliding mechanism is mounted at a low level.

It will be understood that other variations and modifications are also possible. It will be appreciated that the invention encompasses all such variations and modifications that fall within its spirit and scope.

The claims defining the invention are as follows:

1. An apparatus for storing and retrieving one or more items, the apparatus comprising a first part adapted to be mounted to a surface wherein the first part is a base;

a second part adapted to hold one or more items wherein the second part is one of a support frame, drawer and platform;

a sliding mechanism including a part that is slidably movable relative to the first part, opposed guides mounted on the base, and roller arrangements mounted on the second part to engage the guides; and a linkage arrangement including one or more arms pivotally connected at or near one end to the sliding mechanism and pivotally connected at or near another end to the second part, and an offset lever connected to at least one of the one or more arms, wherein the second part is movable relative to the first part such that the second part can be moved from a storage position to a first access position by sliding the second part outwardly relative to the first part, at which the second part is located at one level in the first access position, the second part being movable from the first access position to a second access position by moving the offset lever, the second access position being located at a lower level than the first access position.

2. An apparatus as claimed in claim 1, in which the second access position is operatively lower than the first access position.

3. An apparatus as claimed in claim 1, further comprising a biasing means to assist in moving the second part between the first access position and the second access position.

4. An apparatus as claimed in claim 1 wherein the offset lever is connected to the at least one of the one or more arms at a point located away from an end of the at least one of the one or more arms.

5. An apparatus as claimed in claim 1 wherein movement of the offset lever in an upwards direction causes the second part to lower from the first access position to the second access position and movement of the offset lever in a downwards direction causes the second part to rise from the second access position to the first access position.

6. An apparatus as claimed in claim 5 wherein rotation of the offset lever in an upwards direction causes the second part to lower from the first access position to the second access position and rotation of the offset lever in a downwards direction causes the second part to rise from the second access position to the first access position.

7. An apparatus as claimed in claim 3 wherein one end of the biasing means is connected to the sliding mechanism and another end of the biasing means is connected to the offset lever.

8. An apparatus as claimed in claim 7 wherein the biasing means comprises a gas strut.

9. An apparatus as claimed in claim 1 wherein, when in the storage position, the second part at least partially overlies the first part.

10. An apparatus as claimed in claim 1 wherein, when in the storage position, the second part is positioned at essentially the same level as the first part.

11. An apparatus as claimed in claim 1 further comprising a handle pivotally connected to the offset lever to facilitate movement of the offset lever.

12. An apparatus as claimed in claim 1 comprising a first sliding mechanism, a second sliding mechanism spaced from the first sliding mechanism, a first linkage arrangement located on one side of the second part and a second linkage arrangement located on another side of the second part, each linkage arrangement having an offset lever attached to one arm thereof, and a handle extending from an end of one offset lever to an end of another offset lever.

13. An apparatus as claimed in claim 1 wherein the linkage arrangement includes at least two parallel arms.

14. An apparatus as claimed in claim 1 wherein the offset lever comprises a lever arm and an offset leg extending at an angle to the lever arm, the offset leg being connected to the at least one of the one or more arms at a point located away from an end of the at least one of the one or more arms.

15. An apparatus for storing and retrieving one or more items, the apparatus comprising a first part adapted to be mounted to a surface;

a second part adapted to hold one or more items;

a sliding mechanism including a part that is slidably movable relative to the first part; and a linkage arrangement including one or more arms pivotally connected at or near one end to the sliding mechanism and pivotally connected at or near another end to the second part, an offset lever connected to at least one of the one or more arms, and a handle pivotally connected to the offset lever to facilitate movement of the offset lever, wherein the second part is movable relative to the first part such that the second part can be moved from a storage position to a first access position by sliding the second part outwardly relative to the first part, at which the second part is being at one level in the first access position, the second part being movable from the first access position to a second access position by moving the offset lever, the second access position being located at a lower level than the first access position.

16. An apparatus as claimed in claim 15 herein the first part comprises opposed rails or sliding guides.

17. An apparatus as claimed in claim 16 wherein the sliding rails or guides are mounted to a base and the base is adapted to be mounted to a surface.

18. An apparatus as claimed in claim 15 wherein the second part comprises a support frame or a platform.

19. An apparatus for facilitating access to a car fridge or a tool box stored in a vehicle, the apparatus comprising a base or frame mounted in the vehicle;

a sliding arrangement fixed to the base or frame, the sliding arrangement being slidably movable between a retracted position and an extended position; and a support platform being mounted to the sliding arrangement by a linkage arrangement including one or more arms pivotally connected at or near one end to the sliding mechanism and pivotally connected at or near another end to the second part, and an offset lever connected to at least one of the one or more arms such that when the sliding arrangement is in the extended position, the support platform is movable between a first height that is at essentially the same height as the sliding arrangement and a second height that is lower than a height of the sliding arrangement by moving the offset lever, wherein movement of the offset lever in an upwards direction causes the second part to lower from the first access position to the second access position and movement of the offset lever in a downwards direction causes the second part to rise from the second access position to the first access position.

20. An apparatus as claimed in claim 19 wherein the offset lever is connected to the at least one of the one or more arms at a point located away from an end of the at least one of the one or more arms.

21. An apparatus as claimed in claim 19 wherein the offset lever comprises a lever arm and an offset leg extending at an angle to the lever arm, the offset leg being connected to the at least one of the one or more arms at a point located away from an end of the at least one of the one or more arms.

* * * * *